US005720198A

United States Patent [19]

Nishida et al.

[11] Patent Number: 5,720,198

[45] Date of Patent: Feb. 24, 1998

[54] TRANSFER PRESS

[75] Inventors: Kenji Nishida; Kazuo Ogawa, both of Ishikawa, Japan

[73] Assignee: Komatsu Ltd., Tokyo, Japan

[21] Appl. No.: 624,614

[22] PCT Filed: Aug. 9, 1995

[86] PCT No.: PCT/JP95/01578

§ 371 Date: Apr. 12, 1996

§ 102(e) Date: Apr. 12, 1996

[87] PCT Pub. No.: WO96/05049

PCT Pub. Date: Feb. 22, 1996

[30] Foreign Application Priority Data

Aug. 12, 1994 [JP] Japan ..... 6-212189

[51] Int. Cl.[6] ..... B21D 43/05; B21J 13/04

[52] U.S. Cl. ..... 72/405.1; 72/405.11; 72/455

[58] Field of Search ..... 72/447, 448, 455, 72/404, 405.08, 405.9, 405.1–405.16, 405.01

[56] References Cited

U.S. PATENT DOCUMENTS

| | | | |
|---|---|---|---|
| 3,434,328 | 3/1969 | Taniguchi | 72/405.13 |
| 4,089,205 | 5/1978 | Mizumoto | 72/455 |
| 5,012,665 | 5/1991 | Brandstetter | 72/405 |
| 5,040,404 | 8/1991 | Henderson | 72/448 |
| 5,551,275 | 9/1996 | Hofele | 72/455 |

FOREIGN PATENT DOCUMENTS

| | | | |
|---|---|---|---|
| 3827985 | 2/1990 | Germany | 72/404 |
| 57-82499 | 5/1982 | Japan . | |
| 1-157800 | 6/1989 | Japan . | |
| 2-247031 | 10/1990 | Japan . | |
| 5-177399 | 7/1993 | Japan . | |
| 1292750 | 10/1972 | United Kingdom | 72/455 |

*Primary Examiner*—Daniel C. Crane
*Attorney, Agent, or Firm*—Sidley & Austin

[57] ABSTRACT

The present invention pertains to a transfer press which achieves a reduction in the overall length of the press line and, hence, in the total weight, while ensuring high efficiency and safety of preparatory work, such as changing of idle nests, owing to a facility which permits such a preparatory work to be performed externally of the press. To these ends, the transfer press has: an upright (3) disposed between and commonly possessed by adjacent press units (P1, P2); locating means (4A, 2A) for locating adjacent crowns (4, 4) with respect to each other and adjacent beds (2, 2) with respect to each other, respectively; and a tie rod (7) extending through the boundary between the adjacent beds (2, 2) and through the boundary between the adjacent crowns (4, 4), the adjacent crowns (4, 4) and the adjacent beds (2, 2) respectively being tied together through the upright (3).

12 Claims, 7 Drawing Sheets

TRANSFER PRESS

This application is a 371 of PCT/JP95/01578, filed Aug. 9, 1995.

FIELD OF THE INVENTION

The present invention relates to a transfer press and, more particularly, to a transfer press having a plurality of press units arranged in an end-to-end fashion, each press unit having a modular construction incorporating a crown, a slide, and a bed.

BACKGROUND ART

Hitherto, transfer presses have been designed to have a plurality of working stations in a press main body so that workpieces are successively transferred from one station to the next station by means of a transfer feeder acting between these stations, whereby the workpieces are worked into a final form. In general, the arrangement is such that the first stage, constituted by a drawing press, is followed by second and subsequent stages which are constituted by presses for conducting various additional works, such as trimming, piercing, and so forth.

Transfer presses are also known in which a crown, a slide, and a bed are assembled together to form a press unit having a modular structure, and a plurality of such press units are suitably combined in accordance with the required specifications of the press work (refer to, for example, Japanese Patent Laid-open No. 2-247031). This approach facilitates modification or change of specifications to cope with the diversification of needs, thus offering widened use, as well as a reduction in the cost and an increase in the efficiency of transportation, of transfer presses. A transfer press of the type described is constructed such that successive stages of the press process employ separate crowns, as well as separate beds, and each crown is supported by uprights, wherein one upright is disposed at each side of the connecting surfaces of each of the adjacent crowns and beds. Alternatively, the arrangement is such that, as shown in FIG. 10, a single common upright 53 is disposed on the connecting surfaces of the adjacent crowns 55, 55 and beds 51, 51.

In order to fasten the crowns 55, the upright 53, and the beds 51, a pair of tie rods 56 are inserted into a pair of tie-rod bores extending through these members, and nuts 57 are screwed to and tightened on the upper and lower ends of the tie rods 56, thereby fastening these members. Although not shown, mounting pieces (locating means) are provided on the surfaces of the crowns 55 and the beds 51 at which they are connected to the upright 53, in order to eliminate any positional deviation. In order to minimize the feed stroke for the workpieces, the transfer press of the type described employs an idle station 58 disposed at a position which is at the midpoint of the distance A between the dies of the adjacent stages, i.e., behind each upright 53 which appears at the front side. The idle station has the function of temporarily storing workpieces which are to be fed to the subsequent stage of the process.

In this type of transfer press, a pair of tie rods 56 are received in each upright 53 which is commonly possessed by two adjacent stages of the process, so that the upright inevitably has a large width in the direction of the press line. This inconveniently increases not only the weight but also the feed stroke of the workpiece 60. Consequently, the following problems are encountered:

(1) In order to preserve the feed stroke at a level not greater than a predetermined value, it is necessary to provide each idle station 58 with an idle nest (attachment) 59 for holding the workpieces 60, so that the overall length of the press line is increased. The crowns 55 and the beds 51 of adjacent stages are fastened together by means of a pair of tie rods 56. Consequently, the total weight of the upright 53 and the tie rods 56 is increased and, in addition, the production cost is raised due to the necessity of drilling a pair of elongated bores for receiving the tie rods 56.

(2) Provision of the idle nest 59 between adjacent stages of the process requires a space of a certain length large enough to store the workpieces 60, resulting in a further increase in the feed stroke. Consequently, the above-mentioned distance A between the dies of the adjacent stages and, accordingly, the overall length of the press line are increased.

(3) Preparatory work for changing the idle nests 59 is necessary in accordance with a change in the type of products to be obtained. This, however, requires a troublesome work and poses problems with regard to safety, due to the fact that the idle nests 59 are disposed behind the front uprights 53.

(4) Use of a large number of idle nests 59 enhances the risk of automatic stopping of the press due to, for example, deviation of the position of a workpiece.

(5) In general, the second and subsequent stages perform trimming and piercing, so that reusable sheet materials or intended small articles are generated. It is, however, not easy to take such sheet materials or small articles out of the idle station, because the upright has a large width.

An art as shown in FIG. 9 has been proposed in order to reduce the length of the press line (refer to, for example, Japanese Patent Laid-Open No. 5-177399). In this art, a plurality of beds 51, 52 in the form of segments are arranged end-to-end and a plurality of uprights 53 are provided so as to protrude from these beds 51, 52. These uprights 53 carry segments of support beams 54, which in turn carry crowns 55 of the respective stages arranged in the form of girders spanning these beams 54. The beds 51, 52, the uprights 53, the support beams 54, and the crowns 55 are fastened together by means of tie rods (not shown) which penetrate all or some of these members.

This type of transfer press, however, suffers from a problem in that, since the frames constituted by the support beams 54 in support of the crowns 55 and the bed 52 of the second section are large and heavy, a troublesome work is required to disassemble the whole press into sections of sizes and weights which fall within the limits posed in transportation.

SUMMARY OF THE INVENTION

The present invention has been accomplished to overcome the above-described problems of the known arts. An object of the present invention is to provide a transfer press which has a reduced overall press-line length, as well as a reduced weight. Another object of the present invention is to improve the efficiency of the preparatory work which is required for changing the idle nests and to ensure safety in such work, while facilitating the collection of the reusable sheet materials and the small articles which are generated as a result of the trimming, piercing and other types of work.

According to the present invention, there is provided a transfer press having a plurality of press units arranged end-to-end, each press unit having a modular structure composed of a crown, a slide, and a bed, and transfer means for successively transferring workpieces from each press unit to another press unit which undertakes the next stage of the press process, the transfer press comprising: an upright disposed between and commonly possessed by an adjacent pair of press units among the press units; locating means for locating an adjacent pair of crowns with respect to each other and an adjacent pair of beds with respect to each other; and a tie rod extending through the boundary between an adjacent pair of beds among the beds, through the boundary between an adjacent pair of crowns among the crowns, and through the upright, the adjacent crowns and the adjacent beds being respectively tied together through the upright by the tie rod. Preferably, the feed stroke of the transfer means is determined to be equal to the distance between the dies of the adjacent press units.

A space of a predetermined length can be preserved between a press unit and the press unit which undertakes the next stage, so as to be used as a space for an idle station. The idle station can be provided between the press unit which undertakes the first step of the press process and the press unit which undertakes the second step of the press process. It is also possible to arrange that the idle station is equipped with a feed height changing means or a workpiece posture changing means.

The idle station can be equipped with a truck which is movable into and out of the transfer press in directions perpendicular to the workpiece transfer direction and which carries idle nests, whereby a preparatory work for changing the idle nests can be conducted externally of the transfer press by extracting the truck from the interior of the transfer press. Preferably, the press units have an equal height as measured from the bottoms of the beds to the tops of the crowns, and the beds and the crowns have an equal length as measured in the workpiece transfer direction.

According to the described arrangements, an adjacent pair of crowns, as well as an adjacent pair of beds, can be exactly located with respect to each other and then can be united and fixed together by a single tie rod. Since only one tie rod is used, the width of the upright can be reduced, thus contributing to a reduction in the distance between the dies of the adjacent stages of the process. It is thus possible to obtain a transfer press which can have a reduced overall length of the press line. Furthermore, since the distance between the dies of the adjacent stages, i.e., the feed stroke, can be reduced, it is possible to set the feed stroke to be equal to the above-mentioned distance, thus eliminating the necessity of installing an idle station behind the front upright, which has been necessary in conventional transfer presses. This further contributes to the reduction in the overall length of the press line, as well as in the total weight, while shortening the time required for the transfer of workpieces from one stage to the next stage, thus improving the production efficiency.

The degree of freedom of combination of the press units is enhanced because only a required number of idle stations are to be installed only in the sections which require such idle stations, with the length of each idle station being determined to be equal to the feed stroke. The feed height changing means and other means which are employed as necessary also enhance the adaptability to process design requirements. The truck carrying the idle nests enables preparatory work for changing the idle nests externally of the transfer press, as the truck is extractable from the interior of the press, thus ensuring safety and high efficiency of such a preparatory work. Collection of reusable materials generated through trimming work is facilitated by the use of this truck. When all of the plurality of press units have the same height and the same length, as measured in the workpiece transfer direction, it is possible to add or replace a press unit or units of different process stages and to remove a predetermined press unit or units as required, thus facilitating the process design.

THE BEST MODE FOR CARRYING OUT THE INVENTION

A preferred embodiment of the transfer press in accordance with the present invention will be described with reference to the accompanying drawings.

Figure 1:
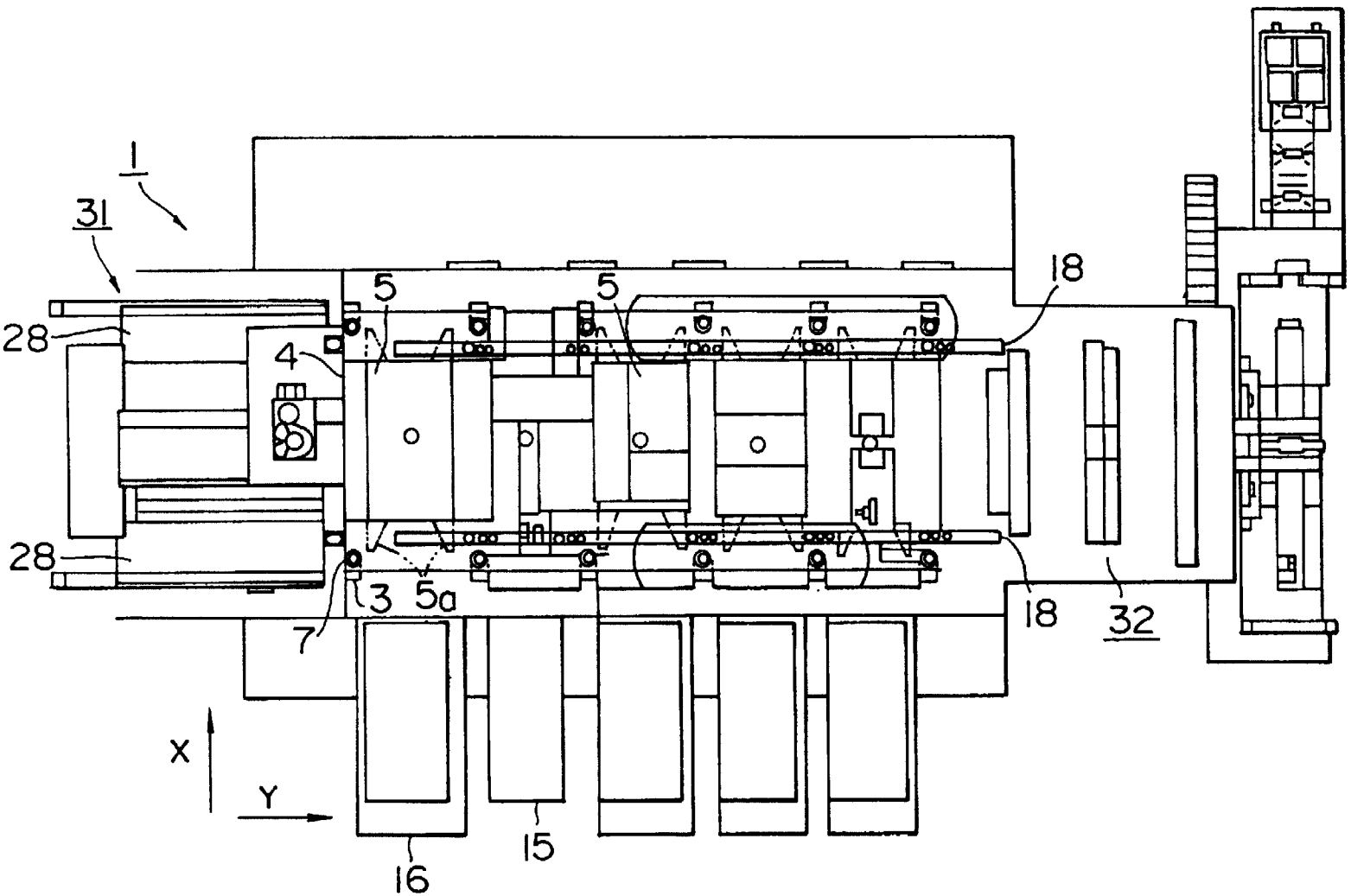
FIG. 1 is a plan view of an embodiment of the transfer press in accordance with the present invention.
Figure 2:
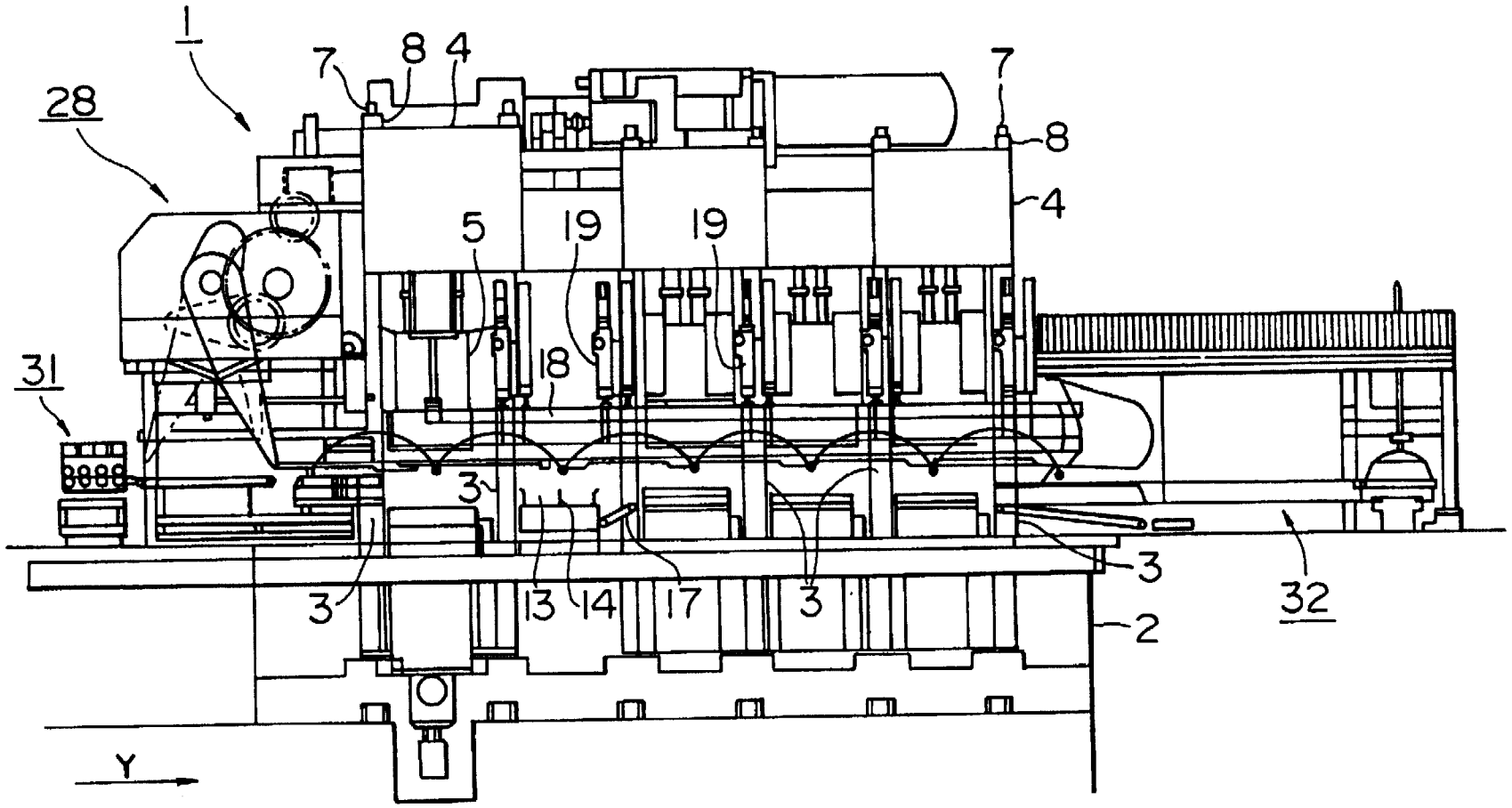
FIG. 2 is a front elevational view of the embodiment of the transfer press.
Figure 3:
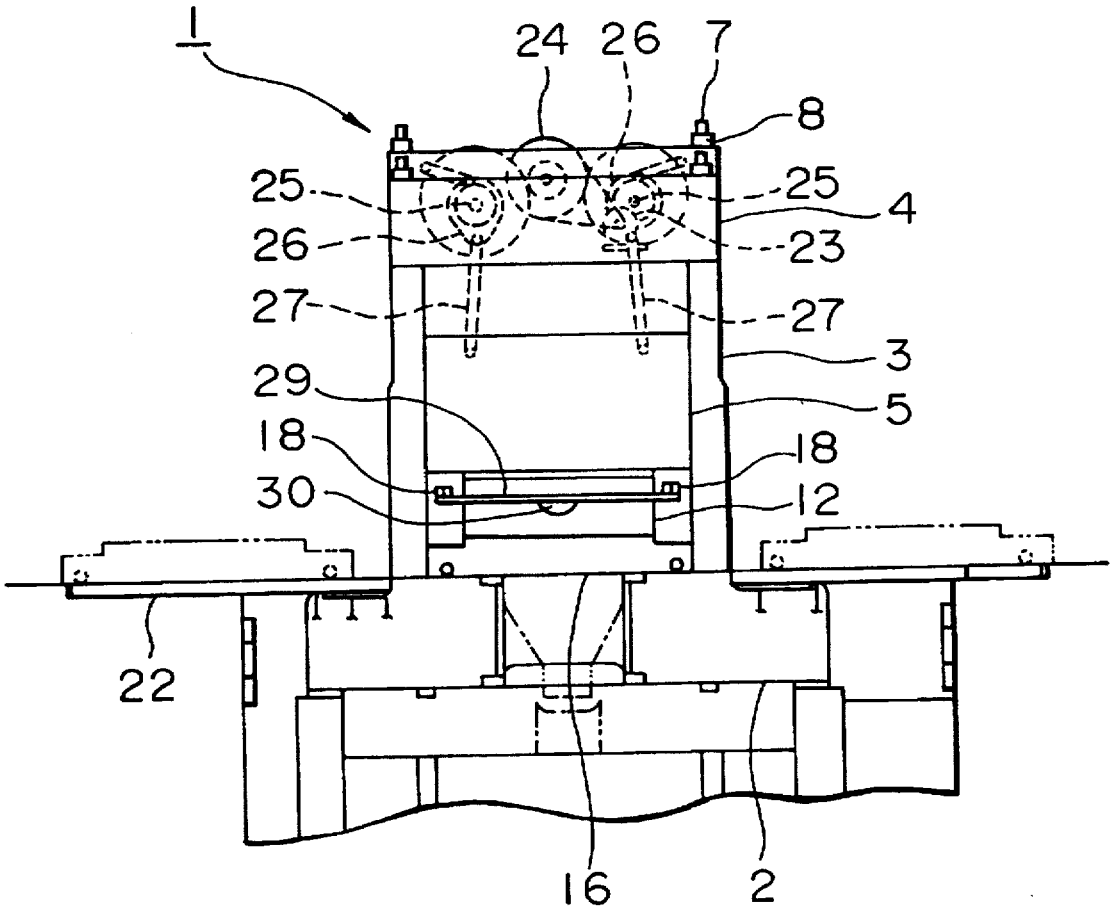
FIG. 3 is an end elevational view of the embodiment of the transfer press.

Referring to FIGS. 1 to 3, a driving electric motor 23, which is mounted on a transfer press 1, rotatingly drives the left and right drive shafts 25, 25 through a driving mechanism 24. The drive shafts 25, 25 are constituted by shaft segments which have a length which is substantially equal to the length Y, as viewed in the workpiece feeding direction, of each of the press units P1, P2, P3, and P4 (each press unit will be represented by Pi, hereinafter) having modular constructions. The arrangement is such that the segments of each of the drive shafts of adjacent press units Pi are splined to each other. The cranks 26, 26 are connected to the drive shafts 25, 25 so as to drive a slide 5 up and down via the cranks 26, 26 and the connecting rods 27, 27, which are pivoted both to the cranks 26, 26 and to the slide 5.

The slide 5 is provided with legs 5*a* fixed to the four corners thereof. These legs 5*a* are guided by the uprights 3 through sliders which are not shown. In order to consecutively feed workpieces to the successive press units Pi, a pair of transfer actuators 28, 28 are provided, one on the front side and one on the rear side of the press. These transfer actuators 28, 28 are driven by the drive motor 23 in synchronization with the vertical stroking of the slide 5. Although in this embodiment all of the press units P1 to P4 are driven by a common single driving electric motor 23, the arrangement can be such that each press unit Pi is driven by an independent driving motor 23 of its own.

Workpiece transfer bars (transfer means) 18, 18, for transferring workpieces, are suspended for vertical movement from a lift actuating means 19 which is supported by each upright 3, and are reciprocatingly moved in the workpiece feeding direction Y with a constant feed stroke by the operation of the transfer actuators 28, 28. The transfer bars 18, 18 carry a predetermined number of cross bars 29, each of which has a workpiece transferring vacuum suction device 30. Numeral 31 denotes a material feeding device for supplying workpiece blanks, while 32 denotes a product receiving device for receiving finally pressed workpieces, i.e., the products.

Figure 8:
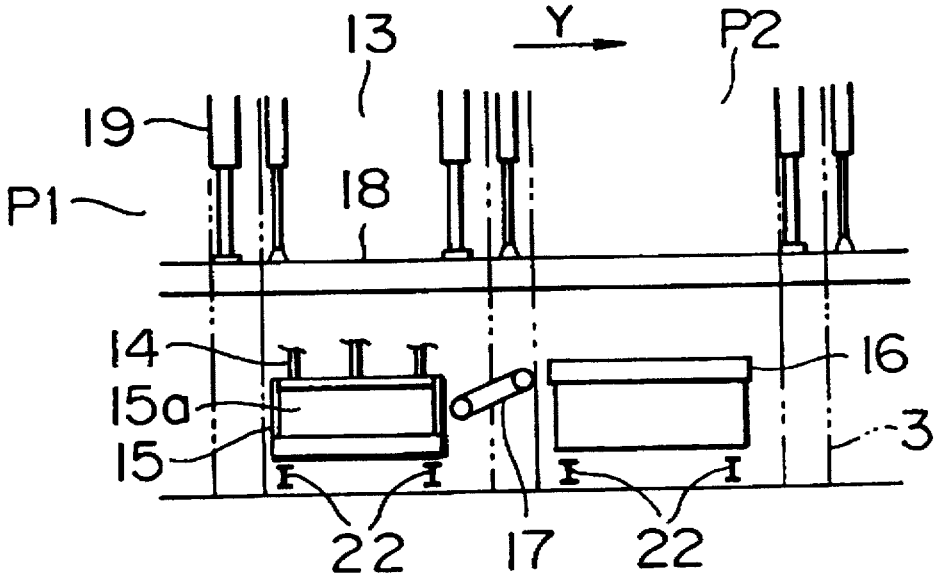
FIG. 8 is an illustration of an idle station shown in FIG. 2 and portions around the idle station.
Figure 9:
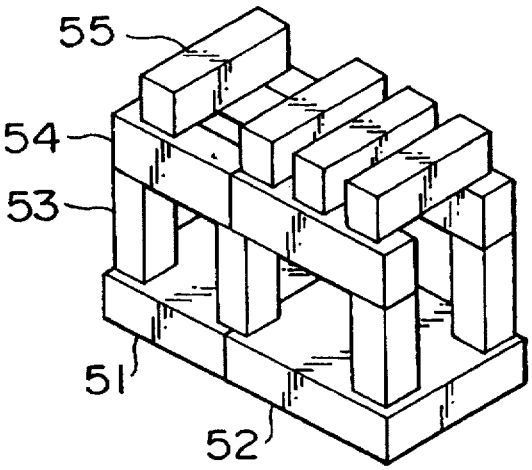
FIG.9 PRIOR ART
FIG. 9 is a perspective view of a conventional transfer press, illustrative of an arrangement of press units.

Referring now to FIG. 8, an idle nest 14 is a jig for temporarily holding a workpiece before the latter is transferred to the next stage. A self-propelled truck 15 runs on rails 22 so as to take reusable materials and small articles out of the press line. Numeral 16 denotes a moving bolster carrying lower dies and adapted to run on rails 22 when the dies are changed.

Figure 4:
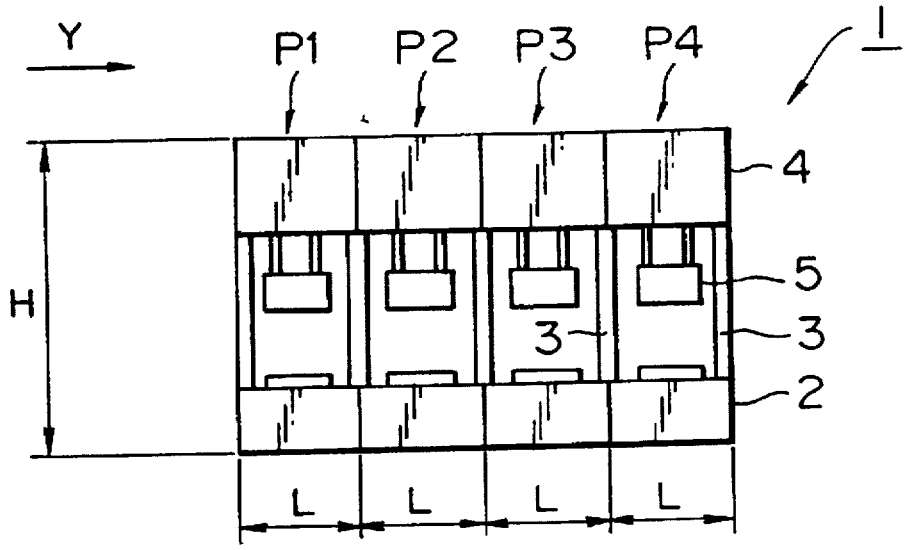
FIG. 4 is a schematic illustration showing the manner in which press units are arranged.

A description will now be given of the construction of each of the press units Pi which constitute the transfer press 1, with specific reference to FIG. 4. Each of the modular type press units P1, P2, P3, and P4 has a height H and a length L, as measured in the workpiece transfer direction Y. The press unit P1, which undertakes the first step of the press process, is a press designed for drawing, while the press units P2, P3, and P4, which respectively serve for the second, third and fourth steps of the process, are designed to perform trimming, piercing, and additional works. Each press unit Pi independently possesses a bed 2, a crown 4 and a slide 5. Uprights 3 for supporting the crowns 4 are provided to protrude from the beds 2 such that each pair of adjacent press units Pi commonly use the same upright 3.

Figure 5:
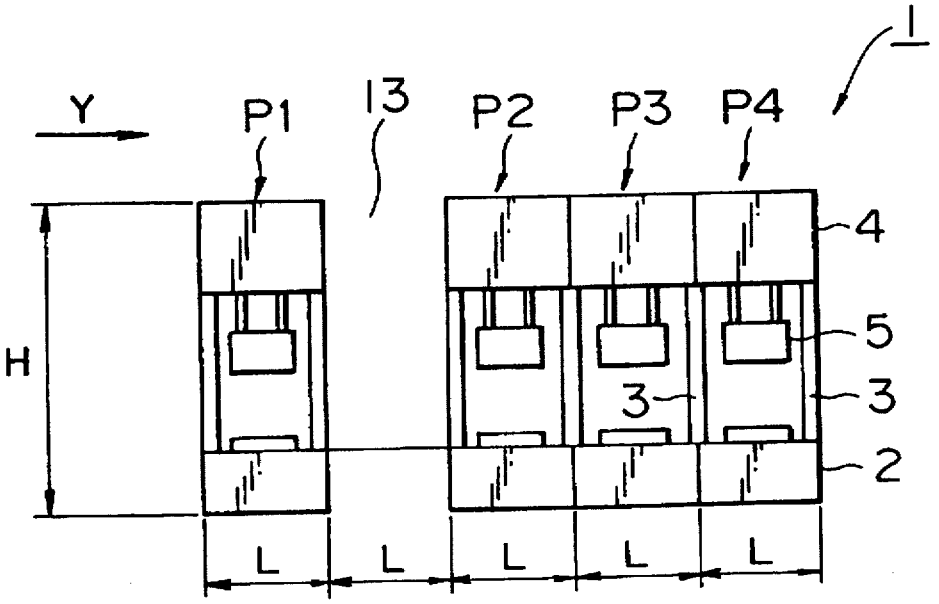
FIG. 5 is a schematic illustration showing the manner in which press units with idle stations are arranged.

An idle station 13 can be disposed between the press units P1 and P2 as necessary, as shown in FIG. 5. The idle station 13 performs functions equivalent to those achieved in known arts, such as change of feed height, change of posture of workpiece, e.g., rotation, turning and so on, and has a length L as measured in the direction Y of the transfer of workpieces.

Figure 6:
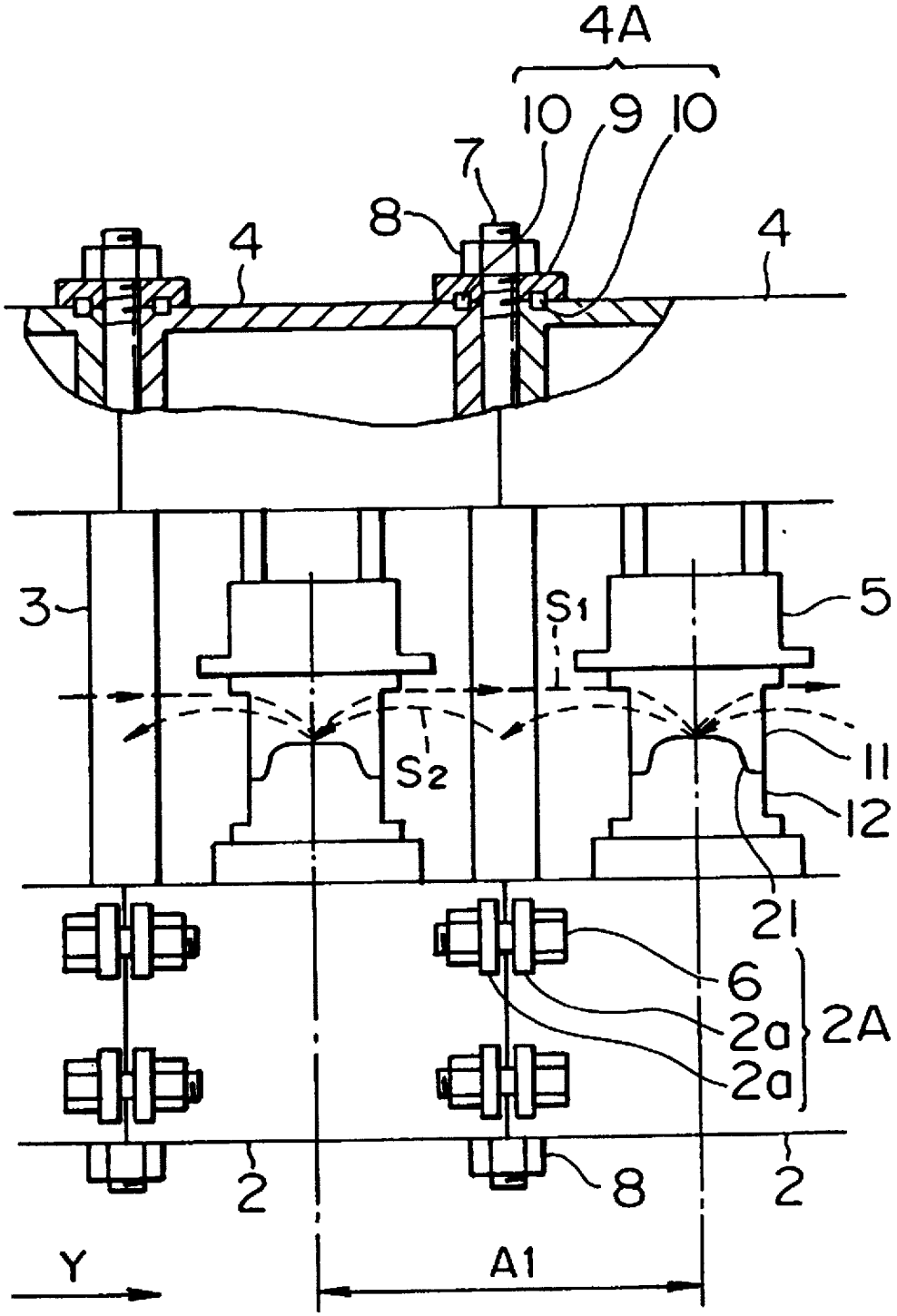
FIG. 6 is a fragmentary front elevational view of the embodiment, illustrative of the detail of the construction which interconnects adjacent press units.

Referring now to FIG. 6, connecting brackets **2*a* are formed on each pair of adjacent beds 2, 2 at positions near the connecting surfaces of these beds 2, 2 at the front and rear sides of the press 1, such that each pair of the associated brackets of the adjacent press units oppose each other. Each pair of associated connecting brackets 2*a*, 2*a* is fastened together by means of a tie bolt 6 so as to eliminate any gap between the confronting connecting surfaces of the adjacent pair of beds 2, 2 and to eliminate any gap between the confronting connecting surfaces of the crowns 4, 4, as shown in FIG. 6. Thus, the connecting brackets 2*a*, 2*a* and the tie bolts 6 cooperate to form locating means 2A, for locating two adjacent beds 2, 2 with respect to each other, and for horizontally securing the two adjacent beds 22 together. A tie rod receiving bore is formed to extend through the connecting surfaces of the adjacent crowns 4, 4, the connecting surfaces of the adjacent beds 2, 2, and the upright 3. A single tie rod 7 is received in this bore with the center of the tie rod 7 being located on the plane where the confronting connecting surfaces of the pair of adjacent press units are joined to each other, as shown in FIG. 6, and the nuts 8, 8 are tightened on both ends of the tie rod 7, whereby the crowns 4 and the beds 2 are fastened together through the intermediary of the upright 3**.

In the illustrated embodiment, the nut 8 on the upper end of the tie bolt is tightened, with a tie plate 9 placed between itself and the upper faces of the adjacent crowns 4, 4. More specifically, each of the adjacent crowns 4, 4 is provided with a keyway formed in the upper face thereof at a position near the connecting surface, while the tie plate 9 is provided in the lower face thereof with a pair of keyways located so as to oppose the keyways formed in the upper faces of the adjacent crowns 4, 4. The nuts 8, 8 are tightened, with keys 10, 10 received in the associated keyways, whereby the adjacent crowns 4, 4 are fastened to each other. Thus, locating means 4A for locating the adjacent crowns 4, 4 is presented by the tie plate 9 and the keys 10, 10. Numerals 11 and 12 denote upper and lower dies which are operable with a feed stroke equal to the distance A1 between the successive stages of the press process. A workpiece under the press work is designated by 21.

Figure 10:
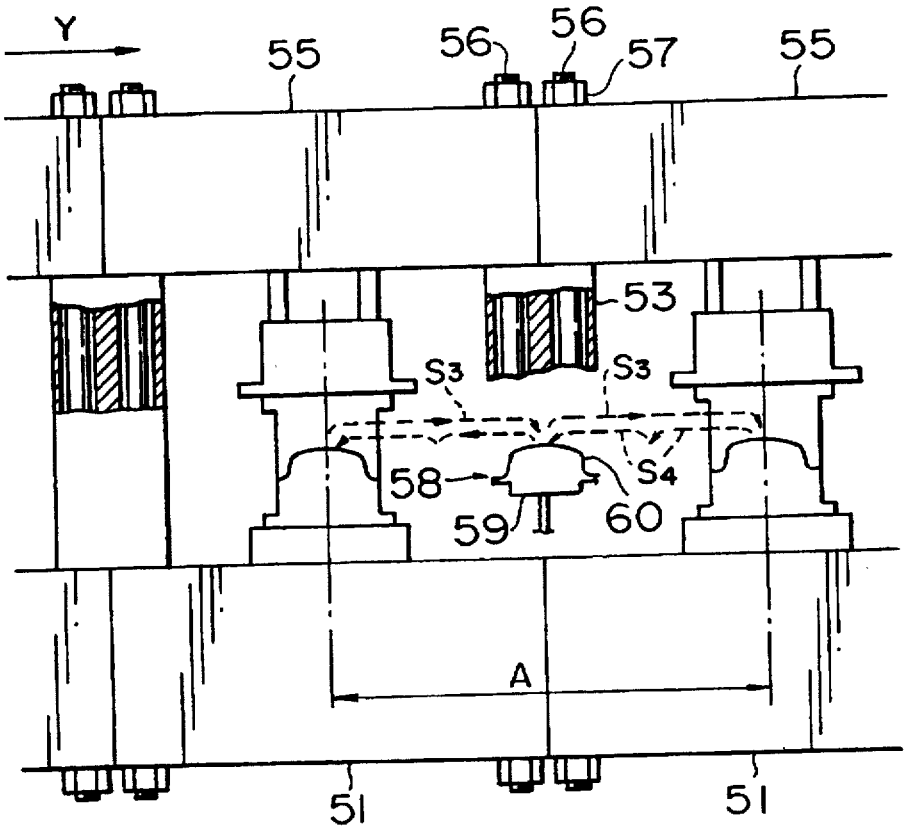
FIG.10 PRIOR ART
FIG. 10 is an illustration of the conventional transfer press, illustrative of the structure for interconnecting press units and portions around the interconnecting structure.

When the illustrated embodiment is equipped with the idle station 13, a space of a size corresponding to the size of a single press unit Pi is preserved between adjacent press units, so as to accommodate the idle station 13. In the conventional transfer press illustrated in FIG. 10, an idle station 58 is disposed at a position which is at the midpoint of the distance A between the dies of the adjacent press units, requiring a space for temporarily storing the workpieces 60 at this position. Thus, the distance A1 between the dies of the adjacent press units of the present invention is much smaller than the distance A between the dies of the adjacent press units in the conventional transfer press of FIG. 10. Furthermore, since only one tie rod 7 is received in each upright 3 for the purpose of fastening the crown 4 and the bed 2 together, the dimension of the upright 3, as measured in the workpiece transfer direction Y, is reduced, thus contributing to the reduction in the distance A1 between the dies of the adjacent press units.

By virtue of these advantageous features, the overall length of the transfer press i is remarkably reduced as compared with that of the conventional transfer press, offering significant reduction both in the installation space and in the cost of the foundation work. The reduction of the distance between the dies of the adjacent press units enables the workpiece 21 to be transferred to the next stage by a single transfer action, thus increasing the speed of the press work.

The transfer path for the workpiece 21 is set so as not to have any flexure, as indicated by a broken line S1 in FIG. 6, whereas the return path is set to have one flexure as indicated by another broken-line curve S2, in order to prevent interference between the dies 11, 12 and the assembly including the crossbars 29 and the vacuum suction devices 30. This should be contrasted to the transfer paths in the conventional transfer press shown in FIG. 10 in which the transfer path of the workpiece 60 includes one flexure as shown by a broken-line curve S3, while the return path includes three flexures as shown by another broken-line curve S4, in order to avoid interference between the dies and the assembly including the crossbars and the vacuum suction devices. Thus, the paths are simplified in the illustrated embodiment, as compared with those in the known arts.

Figure 7:
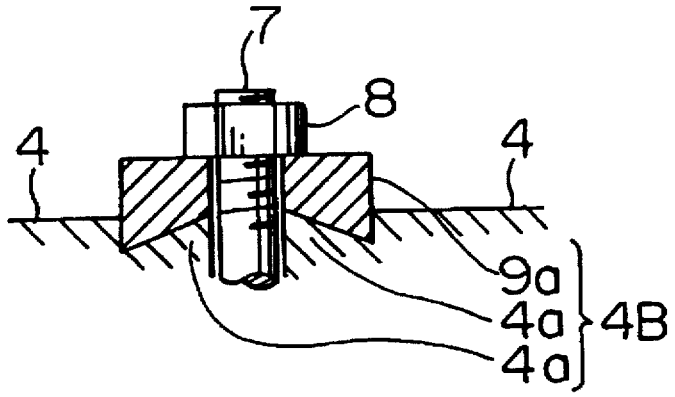
FIG. 7 is a sectional view of a critical portion of the embodiment, illustrative of a different method of interconnecting adjacent crowns.

FIG. 7 illustrates a critical portion of a structure for interconnecting the adjacent crowns 4 in accordance with a different connecting method. The lower face of a tie plate **9*a* has an inverse-wedge shaped cross-section such that both ends of the cross-section project downwardly, while mating wedge-shaped projections 4*a*, 4*a* are formed on the upper faces of the adjacent crowns 4, 4 at positions near the connecting surfaces. In this case, therefore, the tie plate 9*a* and the projections 4*a*, 4*a* cooperate to provide the locating means 4B for locating the adjacent crowns 4, 4** with respect to each other.

A single tie-rod receiving bore is formed so as to extend through the adjoining surfaces of the adjacent crowns 4, 4, the adjoining surfaces of the adjacent beds 2, 2, and the upright 3. A tie rod 7 is inserted into this bore and a nut S is tightened on the upper end of the tie rod 7, so that the wedge-shaped projections 4a, 4a of the crowns 4, 4 are wedged into the inverse wedge-shaped recess of the tie plate 9a, whereby the adjacent crowns 4, 4 are securely and strongly connected and secured to each other.

FIG. 8 shows an arrangement in which an idle station 13 of a length L is provided between the press unit P1 of the first stage and the press unit P2 of the second stage. In the idle station 13, there is a self-propelled truck 15 which runs in a direction perpendicular to the workpiece transfer direction Y. The truck 15 carries the idle nest 14, which temporarily store workpieces 21 (see FIG. 6). Preparatory work for changing the idle nests 14 in accordance with a change in the type of the workpieces 21 can be conducted externally of the press 1, by extracting the self-propelled truck 15 outwardly along the rails 22, whereby the efficiency of the work can be improved. A conveyor belt 17, which descends towards the self-propelled truck 15, is laid between the moving bolster of the second stage and the selfpropelled truck 15.

Reusable materials and small articles are introduced, through the operation of the conveyor belt 17, in a space 15a defined in a lower portion of the self-propelled truck 15, and can easily be collected when the self-propelled truck 15 is extracted. Easy collection of the reusable materials conveniently reduces the stamping cost. In this idle station 13, the self-propelled truck 15 can carry apparatuses such as a feed height changing apparatus for adjusting the height of transfer of the workpieces 21 between adjacent stages, and a posture changing apparatus for changing the posture of the workpiece 21 to enable processing of different portion of the workpiece between adjacent stages, thus facilitating maintenance work to be performed on these apparatuses.

The idle station 13 is installed as necessary, so that the number of idle stations 13 can be reduced, as compared with the conventional transfer presses. This reduces the risk of automatic stopping of the transfer press which otherwise can be caused by, for example, deviation of the positions of the workpieces 21 on the idle nests 14 during transfer of these workpieces, thus contributing to an improvement in the rate of operation of the transfer press, as well as in the production efficiency.

As will be understood from the foregoing description, the transfer press of the described embodiment is constituted by press units having modular structure which are adapted to undertake different stages of the process. This arrangement realizes, for example, about 20% reduction in total weight of the transfer presses of the class having total press capacity of 4000 tons. In addition, transportation is facilitated particularly when the overall size and weight of the transfer press are large, since each of the crown, the slide, and the bed is segmented into sections which are allocated to different stages. The embodiment described hereinbefore employs press units, each having a modular structure constituted by a crown, a slide, and a bed, and the slides of the press units of the different stages are driven independently of one another. This arrangement, however, is not essential. For example, the arrangement can be such that the slides of the second and subsequent stages can be united through tie bolts. It is also possible to serially and consecutively arrange a required number of press units according to the stages of the press work to be performed on the workpieces.

INDUSTRIAL APPLICABILITY

The transfer press in accordance with the present invention offers advantages such as reduction in the overall length of the press line and, hence, in the weight. In addition, preparatory work such as change of idle nests can be done externally of the transfer press, thus ensuring safety in such a preparatory work while improving efficiency. Furthermore, reusable materials generated through trimming and other type of work can easily be collected.

We claim:

1. A transfer press for successively effecting a plurality of press process steps on workpieces, said transfer press comprising:

a plurality of press units, each of said press units having a modular structure composed of a crown, a slide, and a bed; said plurality of press units being arranged in a workpiece feeding direction with at least one pair of said press units being adjacent to each other in said workpiece feeding direction so that each pair of adjacent press units has a pair of beds adjacent each other and a pair of crowns adjacent each other;

a transfer feeder for successively transferring workpieces from a said press unit to another said press unit which undertakes the next step of the press process steps;

a plurality of uprights for supporting adjacent crowns of adjacent press units, each said upright being disposed between and commonly possessed by a pair of adjacent press units;

each pair of adjacent press units having locators for locating that pair of adjacent press units with respect to each other and for horizontally securing that pair of adjacent press units to each other; and each said upright containing only a single tie rod, with each single tie rod extending through a boundary between a pair of adjacent beds, through the respective upright, and through a boundary between a pair of adjacent crowns, with the center of the single tie rod being located on a plane where confronting connecting surfaces of the pair of adjacent press units are joined to each other, so that the adjacent crowns and the adjacent beds of the respective pair of adjacent press units are tied together through the respective upright by the respective tie rod;

wherein the locators for locating a pair of adjacent press units with respect to each other and for securing that pair of adjacent press units to each other comprise a front pair of connecting brackets formed on that pair of adjacent beds at positions near the adjacent ends of that pair of adjacent press units at a front side of the transfer press such that the front pair of connecting brackets oppose each other, and a rear pair of connecting brackets formed on that pair of adjacent beds at positions near the adjacent ends of that pair of adjacent press units at a rear side of the transfer press such that the rear pair of connecting brackets oppose each other.

2. A transfer press in accordance with claim 1, wherein the connecting brackets in a pair of connecting brackets are fastened together by a tie bolt.

3. A transfer press for successively effecting a plurality of press process steps on workpieces, said transfer press comprising:

a plurality of press units, each of said press units having a modular structure composed of a crown, a slide, and a bed; said plurality of press units being arranged in a workpiece feeding direction with at least one pair of said press units being adjacent to each other in said workpiece feeding direction so that each pair of adjacent press units has a pair of beds adjacent each other and a pair of crowns adjacent each other;

a transfer feeder for successively transferring workpieces from a said press unit to another said press unit which undertakes the next step of the press process steps; and a plurality of uprights for supporting adjacent crowns of adjacent press units, each said upright being disposed between and commonly possessed by a pair of adjacent press units;

each pair of adjacent crowns in a pair of adjacent press units having crown locators for locating that pair of adjacent crowns with respect to each other and for securing that pair of adjacent crowns to each other; and each said upright containing only a single tie rod, with each single tie rod extending through a boundary between a pair of adjacent beds, through the respective upright, and through a boundary between a pair of adjacent crowns, with the center of the single tie rod being located on a plane where confronting connecting surfaces of the pair of adjacent press units are joined to each other, so that the adjacent crowns and the adjacent beds of the respective pair of adjacent press units are tied together through the respective upright by the respective tie rod;

wherein each of the crowns has a top surface, and wherein the crown locators for a pair of adjacent crowns comprise a pair of keyways formed in the top surfaces of a pair of adjacent crowns at a position near the adjacent ends of a pair of adjacent press units, a tie plate positioned on each tie rod, each tie plate having a pair of keyways formed therein corresponding to the keyways in the top surfaces of the pair of adjacent crowns, and a pair of keys positioned in the pair of keyways, whereby the crowns of each respective pair of adjacent crowns are fastened to each other.

4. A transfer press in accordance with claim 3, further comprising:

the pair of adjacent beds in a pair of adjacent press units having bed locators for locating that pair of adjacent beds with respect to each other and for securing that pair of adjacent beds to each other;

wherein the bed locators for a pair of adjacent beds comprise a front pair of connecting brackets formed on that pair of adjacent beds at positions near the adjacent ends of that pair of adjacent press units at a front side of the transfer press such that the front pair of connecting brackets oppose each other, and a rear pair of connecting brackets formed on that pair of adjacent beds at positions near the adjacent ends of that pair of adjacent press units at rear side of the transfer press such that the rear pair of connecting brackets oppose each other, wherein each respective front pair of connecting brackets are connected together by at least one bolt, and wherein each respective rear pair of connecting brackets are connected together by at least one bolt.

5. A transfer press in accordance with claim 3, wherein each of the beds has a bottom and a length in the workpiece feeding direction, wherein each of the crowns has a top and a length in the workpiece feeding direction, wherein the heights of the plurality of press units are equal to each other as measured from the bottoms of said beds to the tops of said crowns, and wherein the length of each bed and the length of each crown are equal to each other as measured in the workpiece feeding direction.

6. A transfer press in accordance with claim 3, wherein the locators for locating a pair of adjacent press units with respect to each other and for securing that pair of adjacent press units to each other comprise at least one tie bolt which bolts together the adjacent beds of that pair of adjacent press units so as to horizontally secure the adjacent beds together.

7. A transfer press in accordance with claim 3, wherein the locators horizontally secure the pair of adjacent press units to each other so as to eliminate any significant gap between the confronting connecting surfaces of that pair of adjacent press units.

8. A transfer press for successively effecting a plurality of press process steps on workpieces, said transfer press comprising:

a plurality of press units, each of said press units having a modular structure composed of a crown, a slide, and a bed; said plurality of press units being arranged in a workpiece feeding direction with at least one pair of said press units being adjacent to each other in said workpiece feeding direction so that each pair of adjacent press units has a pair of beds adjacent each other and a pair of crowns adjacent each other;

a transfer feeder for successively transferring workpieces from a said press unit to another said press unit which undertakes the next step of the press process steps; and a plurality of uprights for supporting adjacent crowns of adjacent press units, each said upright being disposed between and commonly possessed by a pair of adjacent press units;

the pair of adjacent crowns in a pair of adjacent press units having crown locators for locating that pair of adjacent crowns with respect to each other and for securing that pair of adjacent crowns to each other; and each said upright containing only a single tie rod, with each single tie rod extending through a boundary between a pair of adjacent beds, through the respective upright, and through a boundary between a pair of adjacent crowns, with the center of the single tie rod being located on a plane where confronting connecting surfaces of the pair of adjacent press units are joined to each other, so that the adjacent crowns and the adjacent beds of the respective pair of adjacent press units are tied together through the respective upright by the respective tie rod;

wherein each of the crowns has a top surface; and wherein the crown locators for a pair of adjacent crowns comprise a tie plate positioned on a tie rod and having a lower surface in the form of an inverse-wedge shape so that both ends project downwardly; the top surfaces of that pair of adjacent crowns having, at a position near the adjacent ends of the pair of adjacent press units, wedge-shaped projections which mate with the inverse-wedge shaped lower surface of the tie plate to locate the pair of adjacent crowns with respect to each other, whereby the crowns of each respective pair of adjacent crowns are fastened to each other.

9. A transfer press in accordance with claim 8, further comprising:

the pair of adjacent beds in a pair of adjacent press units having bed locators for locating that pair of adjacent beds with respect to each other and for securing that pair of adjacent beds to each other;

wherein the bed locators for a pair of adjacent beds comprise a front pair of connecting brackets formed on that pair of adjacent beds at positions near the adjacent ends of that pair of adjacent press units at a front side of the transfer press such that the front pair of connecting brackets oppose each other, and a rear pair of connecting brackets formed on that pair of adjacent beds at positions near the adjacent ends of that pair of adjacent press units at a rear side of the transfer press such that the rear pair of connecting brackets oppose each other, wherein each respective front pair of connecting brackets are connected together by at least one bolt, and wherein each respective rear pair of connecting brackets are connected together by at least one bolt.

10. A transfer press in accordance with claim 8, wherein each of the beds has a bottom and a length in the workpiece feeding direction, wherein each of the crowns has a top and a length in the workpiece feeding direction, wherein the heights of the plurality of press units are equal to each other as measured from the bottoms of said beds to the tops of said crowns, and wherein the length of each bed and the length of each crown are equal to each other as measured in the workpiece feeding direction.

11. A transfer press in accordance with claim 8, wherein the locators for locating a pair of adjacent press units with respect to each other and for securing that pair of adjacent press units to each other comprise at least one tie bolt which bolts together the adjacent beds of that pair of adjacent press units so as to horizontally secure the adjacent beds together.

12. A transfer press in accordance with claim 8, wherein the locators horizontally secure the pair of adjacent press units to each other so as to eliminate any significant gap between the confronting connecting surfaces of that pair of adjacent press units.

* * * * *